United States Patent [19]

Gary

[11] Patent Number: 4,905,131

[45] **Date of Patent: * Feb. 27, 1990**

[54] BRACKET FOR DECORATIVE LIGHTING

[75] Inventor: Lonnie F. Gary, Lubbock, Tex.

[73] Assignee: Gary Products Group, Inc., Lubbock, Tex.

[ * ] Notice: The portion of the term of this patent subsequent to Jul. 25, 2006 has been disclaimed.

[21] Appl. No.: 294,269

[22] Filed: Jan. 6, 1989

Related U.S. Application Data

[63] Continuation-in-part of Ser. No. 229,563, Aug. 5, 1988, Pat. No. 4,851,977.

[51] Int. Cl.[4] ..... F21V 21/00

[52] U.S. Cl. ..... 362/249; 362/432; 362/152; 362/234; 248/315; 52/58

[58] Field of Search ..... 362/145, 152, 249, 432, 362/457, 385, 806, 396, 234, 253, 458, 382, 430, 151, 147, 227, 457; 248/314, 315, 48.1, 48.2, 309.1, 300; D26/138, 140; 211/70.6, 70.1, 26, 89

[56] References Cited

U.S. PATENT DOCUMENTS

| | | | |
|---|---|---|---|
| 2,269,589 | 1/1942 | Kaufman | 362/806 |
| 3,133,147 | 5/1964 | Auld, Jr. et al. | 174/154 |
| 3,182,944 | 5/1965 | Laviano | 248/315 |
| 3,307,811 | 3/1967 | Anderson | 174/154 |
| 3,341,699 | 9/1967 | Somermeyer | 362/145 |
| 3,408,780 | 11/1968 | Brister | 52/58 |
| 3,540,687 | 11/1970 | Cuva | 362/249 |
| 3,861,632 | 1/1975 | Siilats | 362/432 |
| 3,883,926 | 5/1975 | Reynolds | 362/432 |

*Primary Examiner*—Ira S. Lazarus
*Assistant Examiner*—D. M. Cox
*Attorney, Agent, or Firm*—Ross, Howison, Clapp & Korn

[57] ABSTRACT

Apparatus and method for installing and displaying exterior decorative lighting on a roof structure. The apparatus comprises a face portion having an aperture for receiving a decorative light bulb or socket and a base portion that is inserted between adjoining layers of shingles or other building materials and is maintained there by frictional engagement until manually removed. One or more tabs are preferably provided on the base portion to enhance frictional engagement with the support surface. An annular collar with a tapered inside surface defining the aperture is provided to enhance frictional engagement between the face portion and the decorative bulb or socket.

19 Claims, 5 Drawing Sheets

BRACKET FOR DECORATIVE LIGHTING

CROSS-REFERENCE TO RELATED APPLICATION

This patent application is a continuation-in-part of United States Application Ser. No. 07/229,563, filed Aug. 5, 1988, now U.S. Pat. No. 4,851,977.

TECHNICAL FIELD

This invention relates to devices useful for installing and displaying decorative lighting, and more particularly, to brackets adapted to support decorative lights. One aspect of the invention relates to a plastic or metal bracket that will support a decorative light, and can be installed without screws, nails, or other hardware. Another aspect of the invention relates to a mounting bracket for decorative lighting that is itself supported by frictional engagement with a support structure.

BACKGROUND OF THE INVENTION

The use of decorative lighting, and particularly exterior decorative lighting, on residences and businesses is well known. A major portion of exterior decorative lighting is seasonal in nature, such lighting being installed primarily during holiday periods and then removed once the holiday period has passed. Decorative lights are typically purchased in "strings" in which a large number of individual sockets are wired together, and bulbs, frequently colored, are inserted into each socket. Plugs are provided at one or both ends for connection with other light strings or to an electrical power source.

The present invention is directed to deficiencies that have been encountered with devices previously used to install and display decorative lighting. In the past, exterior decorative lights have sometimes been installed by stapling light strings onto the eve or fascia of a building. Stapling often causes wires to be severed during installation, however, and leaves unattractive holes in the support surface when the decorative lighting and staples are removed. Threaded hooks have also been used to support light strings in the past, but the hooks themselves are difficult to install, and do not secure the bulbs or sockets in a preferred orientation.

Some have previously disclosed brackets and other similar apparatus for use in supporting decorative light sockets. Such brackets are shown, for example, in U.S. Pat. Nos. 3,182,944; 3,189,310; 3,275,818; 3,540,687; 3,692,993; 4,128,863; and 4,714,219. The devices shown in these patents, however, require the use of a nail or threaded fastener to install the bracket on the underlying support structure.

Others have disclosed brackets for use with decorative lighting that do not require nails or threaded fasteners for installation, but rather, are adapted to hang from a gutter or eaves trough. Such brackets are disclosed, for example, in U.S. Pat. Nos. 3,341,699; 3,599,918 and 3,861,632.

Light display means employing magnets are similarly disclosed in U.S. Pat. Nos. 3,275,818 and 3,970,837.

Light display means employing spring clips are disclosed in U.S. Pat. Nos. 3,275,818; 3,883,926; and 4,491,902.

Devices employing flat flanges, bases or flashing plates adapted to be inserted between shingles for securing antenna leads or antenna wire tie downs are disclosed in U.S. Pat. Nos. 3,133,147; 3,307,811; and 3,408,780.

A baby bottle support member having a flat flange adapted to be inserted into spaced parallel slots is disclosed in U.S. Pat. No. 2,723,818.

SUMMARY OF THE INVENTION

According to the present invention, a bracket useful for displaying decorative lighting is provided that does not require the use of nails, threaded fasteners, gutters or magnets in order to install such lighting on the exterior rooflines of residences or many other buildings. The brackets disclosed herein permit quick and efficient installation of decorative lighting, and are particularly useful with roofs comprising composition or wood shingles. The brackets disclosed herein will uniformly support decorative light sockets and bulbs in a preferred orientation for attractive display on the exterior of many buildings. The brackets disclosed herein permit decorative lighting to be attached or removed quickly without damage to the underlying support structure of the building. The brackets disclosed herein can be reused repeatedly with different decorative light strings.

According to a preferred embodiment of the invention, a bracket for decorative lighting is provided that comprises a base adapted to be inserted between overlapping shingles on a building having a shingle roof.

According to another preferred embodiment of the invention, a bracket for decorative lighting is provided that comprises an aperture adapted for use with decorative bulbs of different sizes.

According to another preferred embodiment of the invention, a bracket for decorative lighting is provided that comprises a base portion adapted to be inserted between adjacent and overlapping layers of a building structure, the base portion being further provided with a foldable or flexible tab adapted to improve the frictional engagement between the base portion and the adjacent and overlapping layers of the building structure whenever the base portion is inserted therebetween.

According to another preferred embodiment of the invention, a bracket for decorative lighting is provided that comprises an aperture for receiving a decorative bulb or bulb socket, and a substantially cylindrical collar extending around the aperture and having slightly tapered inside walls adapted to frictionally engage the outer surface of the decorative bulb or bulb socket.

According to another preferred embodiment of the invention, a method for installing decorative lighting is provided that comprises the steps of providing a bracket as disclosed herein; securing the base of a decorative light bulb to the bracket; folding each tab on the base portion of the bracket to form an acute angle between the tab and the remainder of the base portion, with the fold line between the tab and the remainder of the base portion being the vertex of the acute angle; and thereafter inserting the base portion of the subject bracket between overlapping layers of a building structure.

BRIEF DESCRIPTION OF THE DRAWINGS

The present invention is further described and explained in relation to the following drawings wherein.

Like reference numerals are used to indicate like parts in all figures of the drawings.

DESCRIPTION OF THE PREFERRED EMBODIMENTS

Figure 1:
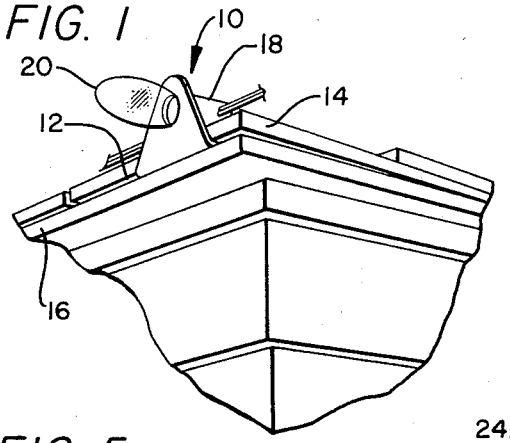
FIG. 1 is a perspective view depicting decorative lighting installed and displayed on the roofline of a building by means of the decorative lighting support bracket of the invention.
Figure 2:
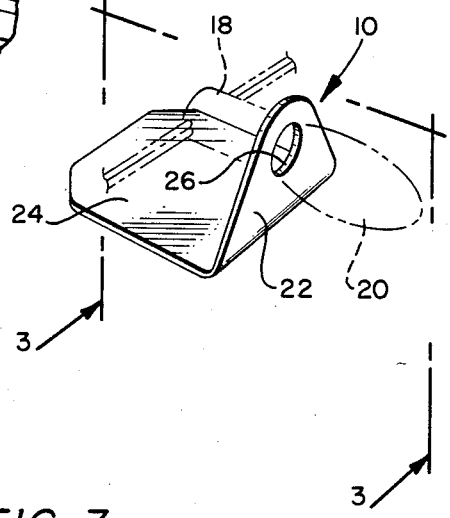
FIG. 2 is a perspective view depicting one embodiment of the decorative lighting support bracket of the invention (with a decorative light bulb, socket and wire shown in phantom) apart from any support structure.
Figure 5:
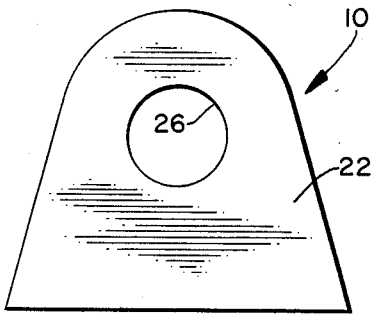
FIG. 5 is a front elevational view of the decorative lighting support bracket of FIG. 2.
Figure 3:
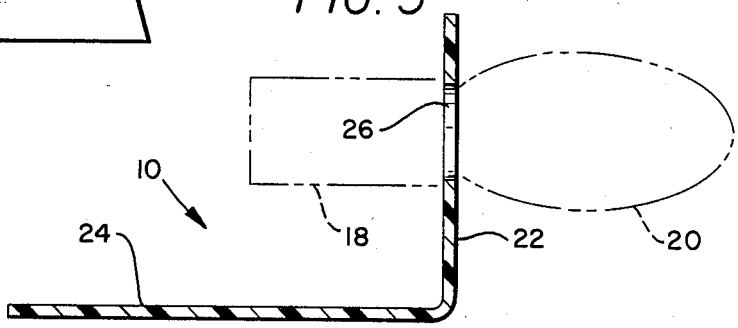
FIG. 3 is a sectional side elevational view of the subject invention taken along line 3—3 of FIG. 2.

As installed in FIG. 1, decorative lighting support bracket 10 preferably supports, maintains and displays a decorative light set comprising socket 18 and bulb 20 in substantially fixed relation to shingle 14 and decking 16 of a building roof structure. Referring to FIGS. 1 through 3 and 5, decorative lighting support bracket 10 of the invention preferably comprises bracket base end member 24 (disposed proximally to the roof when installed), bracket face portion 22 (disposed distally from the proximal end member), and at least one aperture 26 disposed in bracket face portion 22.

The decorative light is desirably connected to bracket 10 by inserting the base of bulb 20 through aperture 26 and then into socket 18 disposed on the opposite side of bracket face portion 22 therefrom. When bracket 10 is to be installed as shown in FIG. 1, bulb 20 desirably faces away from the proximal end of bracket base end member 24. With most commercially available decorative light sets, the base (not shown) of bulb 20 is adapted to threadedly engage socket 16, although some sets may rely on unthreaded frictional engagement between socket 18 and bulb 20.

Once socket 18 and bulb 20 are connected to bracket 10, or prior thereto if preferred, bracket base 24 is desirably inserted between adjacent abutting or overlapping layers of building materials such as shingle 14 and decking 16 in FIG. 1. Depending upon the construction of the particular building with which brackets 10 are utilized, bracket base 24 can also be inserted between adjacent layers of other building materials as well. Thus, for example, the decorative light support brackets of the invention can be similarly inserted between composition shingles, between cedar shakes, between roof decking and fascia boards, or between other facing and opposed building materials where manual force is sufficient to insert bracket base 24 therebetween, and where the resultant frictional engagement between the top and bottom surfaces of bracket base 24 and the building materials facing and contacting such surfaces is sufficient to maintain the desired positional relationship of bracket base 24, once inserted, with respect thereto.

According to one preferred embodiment of the invention, bracket 10 is injection molded from a polymeric resin such as polypropylene or impact grade polystyrene, with bracket base 24 and bracket face 22 each having a thickness of about 1/16 inch (0.16 cm). However, it will become apparent to one of ordinary skill in the art upon reading this disclosure that devices within the scope of the invention can also be made of other plastics, or of metal such as aluminum or galvanized sheet. Although injection molding is a satisfactory method of manufacturing the subject devices from a moldable polymeric resin, it will be understood that they can also be made by extruding or thermoforming the desired shape and thereafter trimming or punching as desired to obtain the final configuration.

Figure 4:
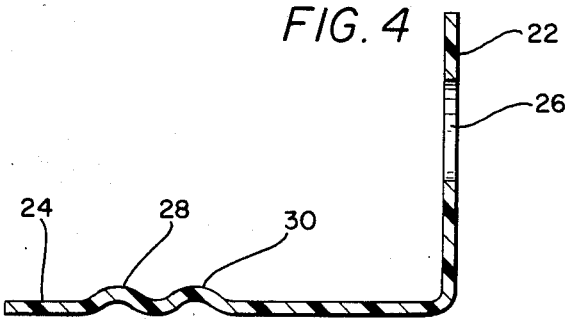
FIG. 4 is a sectional side elevational view of another embodiment of the decorative lighting support bracket of the invention.

Referring to FIG. 4, according to another embodiment of the invention, undulations 28, 30 or other similarly useful surface texturing or variations can be employed to increase or enhance the frictional engagement between bracket base 24 and the building material surfaces with which its major surfaces are in contact. Such undulations should not, however, be so great as to increase the thickness of bracket base 24 beyond the limits than will enable bracket base 24 to be installed or removed through the application of reasonable manual force.

Figure 6:
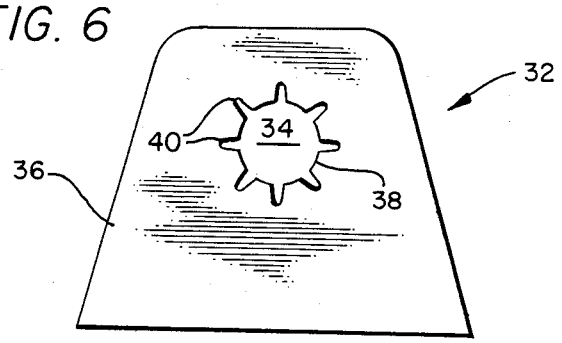
FIG. 6 is a front elevational view of another embodiment of the decorative lighting support bracket of the invention.

Referring to another embodiment of the invention as shown in FIG. 6, bracket face portion 36 of bracket 32 comprises aperture 34 having a plurality of notches 40 separated by webs 38. When aperture 34 is configured as shown in FIG. 6, and is made of a material sufficiently flexible to permit webs 38 to be deformed by inserting a decorative bulb therethrough, aperture 34 will accommodate decorative bulbs of different sizes.

Figure 7:
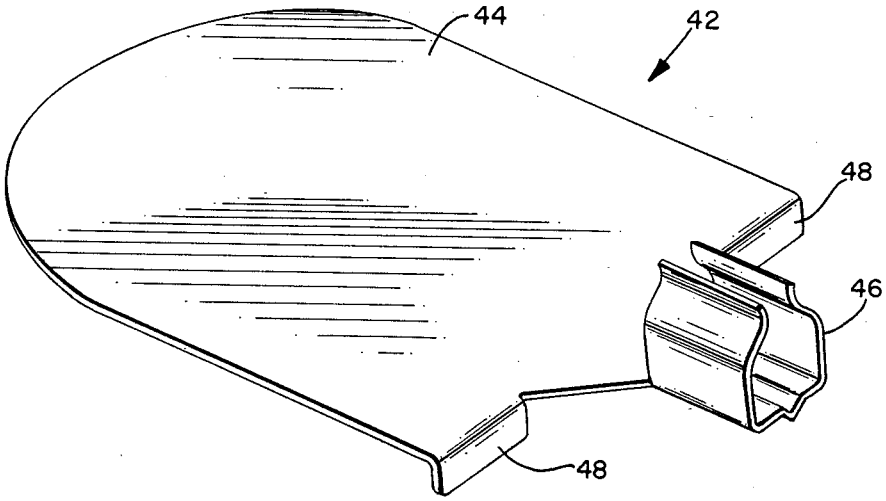
FIG. 7 is a perspective view of another embodiment of the decorative lighting support bracket of the invention.

Referring to FIG. 7, decorative bulb support device 42 is another embodiment of the invention that comprises elongate base member 44 and bulb retainer clip 46. Device 42 is preferably constructed from sheet metal, and tabs 48 are provided to limit the distance base member 44 can be inserted between adjacent layers of building materials during installation.

Figure 8:
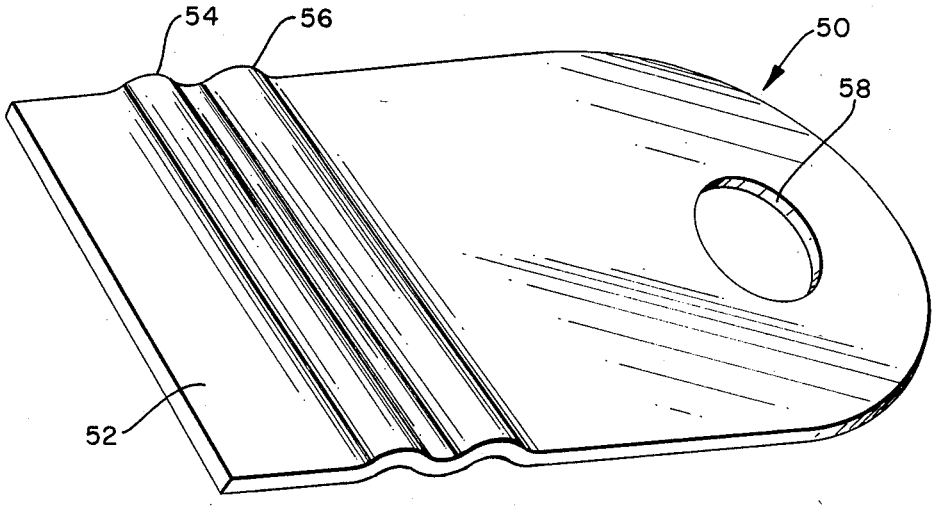
FIG. 8 is a perspective view of another embodiment of the decorative lighting support bracket of the invention.

Yet another embodiment of the invention is disclosed in FIG. 8, wherein bracket 50 comprises enlongate base member 52 having surface undulations 54, 56 disposed therein. At least one aperture 58 of suitable diameter is provided for insertion of a decorative bulb therethrough and connection to a socket disposed on the opposite side thereof.

Figure 9:
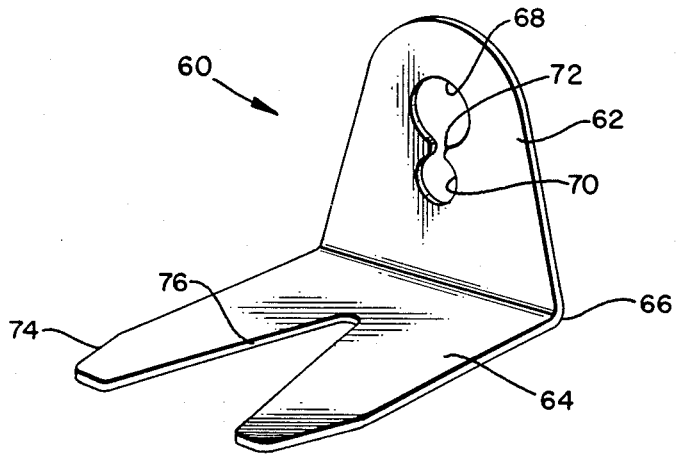
FIG. 9 is a perspective view of another embodiment of the decorative lighting support bracket of the invention.

A particularly preferred embodiment of the invention is shown in FIG. 9, and is further described in relation thereto. Referring to FIG. 9, bracket 60 preferably comprises elongate proximal bracket base member 64 and bracket face portion 62 joined along fold line 66. Although the included angle between base member 64 and face portion 62 can vary within the scope of the invention, an included angle of about 90 degrees has proved to be satisfactory for supporting and displaying decorative lights on residential roofs having roofs with commonly encountered pitches. Tapers 74 are provided to assist insertion of base member 64 between adjacent layers of building materials such as shingles disposed along a roofline, and notch 76 is provided to accommodate any fastening device utilized in applying such building materials that might otherwise interfere with the use or placement of the subject brackets. A dual diameter aperture comprising segments 68, 70 separated by opposed shoulders 72 is preferably provided in bracket face portion 62 to accommodate decorative bulbs in two commonly encountered commercially available sizes. Because of the presence of shoulder 72, a decorative light having a relatively small diameter base can be used with aperture 70 in bracket 60 without falling through the larger diameter segment 68.

Figure 10:
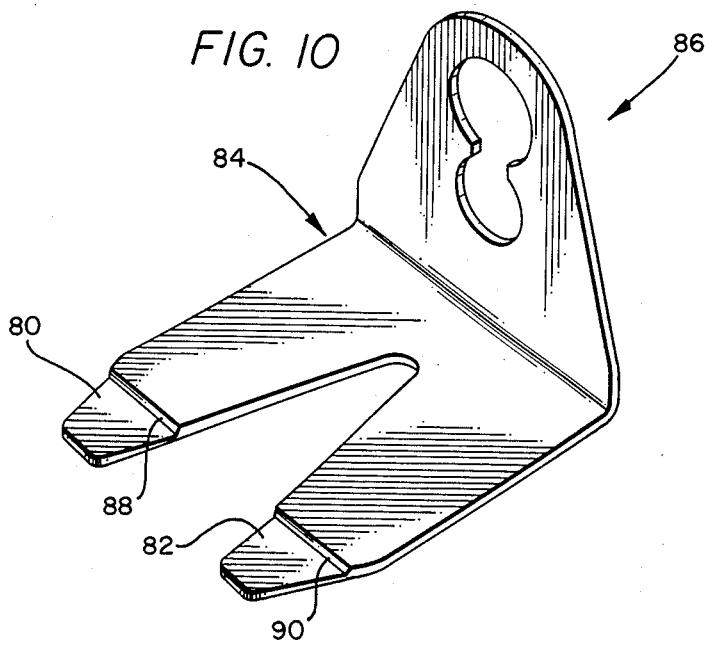
FIG. 10 is a perspective view of another embodiment of the decorative lighting support bracket of the invention.
Figure 11:
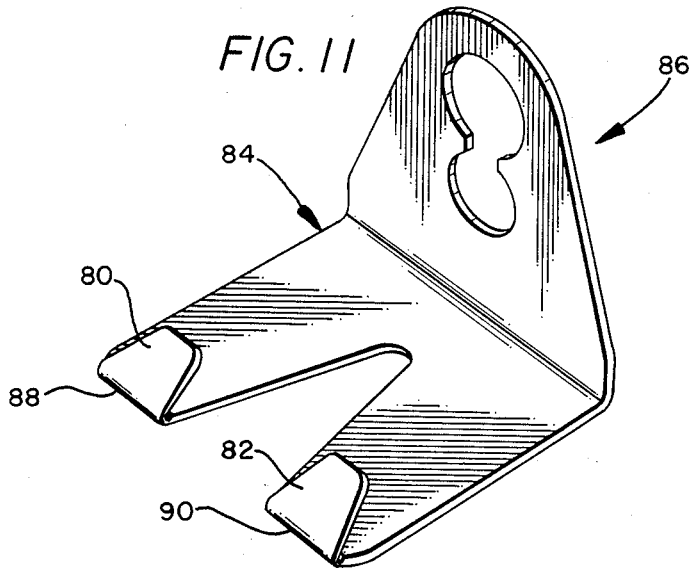
FIG. 11 is a perspective view of the same decorative lighting support bracket shown in FIG. 10, but having the tabs of the base portion folded upward.

Referring to FIGS. 10 and 11, another embodiment of the invention is shown in which tabs 80, 82 are provided at the open end of base member 84 of bracket 86 for use in enhancing the frictional engagement between bracket 86 and the layers of building materials that define the surfaces between which base member 84 is inserted during installation. Fold lines 88, 90 are preferably regions of reduced thickness extending transversely across base member 84. Prior to inserting base member 84 between the facing support surfaces (not shown), tabs 80, 82 are preferably folded upwards from the flat position shown in FIG. 10 to the elevated position shown in FIG. 11. When base member 84 of bracket 86 is inserted between adjacent layers of building materials, the undersides of fold lines 88, 90 become the leading edges of base member 84, and tabs 80, 82 form an acute angle with the remainder of base member 84. The size of the acute angle thus formed will vary according to the thickness of the space into which base member 84 is being inserted, and assuming that the material from which bracket 86 is constructed has some degree of elastic memory, the angle between the tabs and base member will conform to the available space once the base member is inserted to the desired extent.

While the embodiment shown in FIGS. 10 and 11 is preferred, it is understood that the invention can be similarly implemented with analogous structure in differing configurations. Thus, for example, tabs 80, 82 can be shaped differently within the scope of the invention, can be directed upwards or downwards, or both, to enhance the frictional engagement as discussed above, and may utilize a configuration different than the fold line shown in FIGS. 10 and 11 for establishing the intersection of tabs 80, 88 with the remainder of base member 84.

Figure 12:
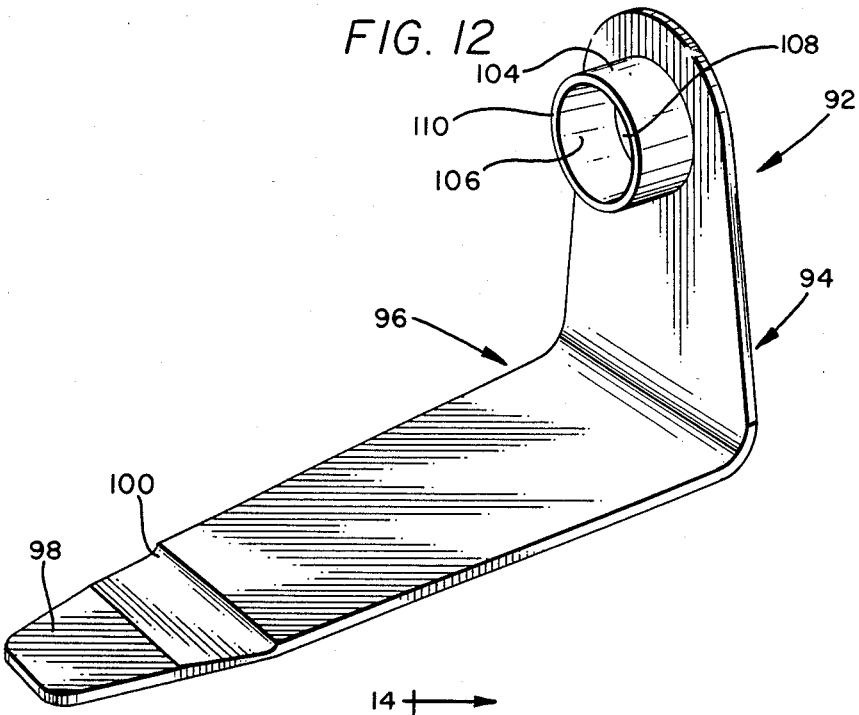
FIG. 12 is a perspective view of another embodiment of the decorative lighting support bracket of the invention.
Figure 13:
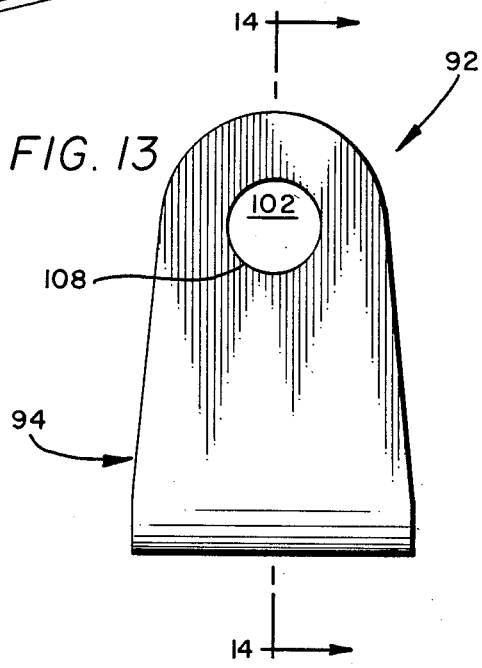
FIG. 13 is a front (as installed) elevation view of the decorative lighting support bracket of FIG. 12.
Figure 14:
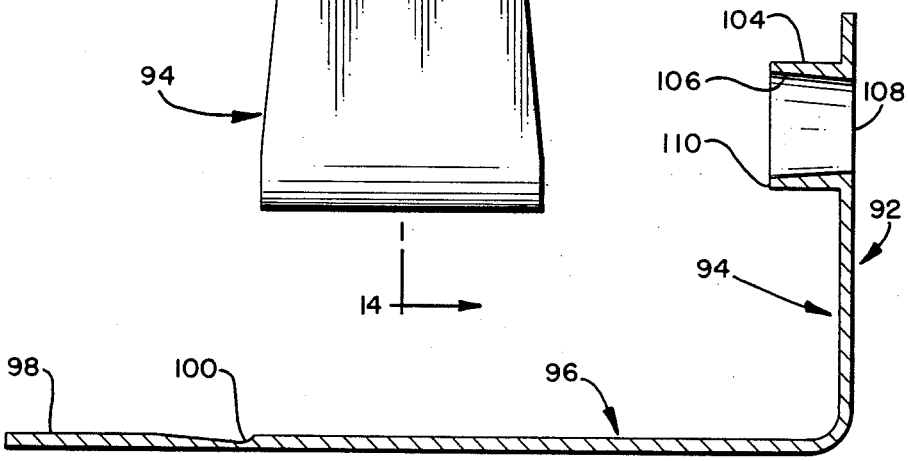
FIG. 14 is a sectional side elevation view taken longitudinally through the decorative lighting support bracket of FIG. 12, with the foldable tab on the base portion shown in the unfolded position.

Another preferred embodiment of the invention is disclosed and further described in relation to FIGS. 12, 13 and 14, in which bracket 92 preferably comprises face portion 94 and base portion 96. Bracket 92 is desirably used for installing mini-lights, and is more slender than bracket 86 as shown in FIGS. 10 and 11. Because of its narrower overall width, base portion 96 does not include a notched section, and comprises a single tab 98. Tab 98 is separated from the remainder of base portion 96 by zone 100 of reduced thickness which extends transversely across base portion 96. During use, tab 98 is preferably folded upward as with tabs 80, 82 in FIGS. 10 and 11 to enhance frictional engagement between base portion 96 and the facing support surfaces.

Face portion 94 preferably further comprises aperture 102 defined by interiorly facing surface 106 of collar 104. Collar 104 is further defined by forward edge 108 and rear edge 110. According to one preferred embodiment of the invention, bracket 92 is made of plastic and collar 104 is integrally molded with face portion 94. Surface 106 preferably tapers slightly inward between rear edge 110 and forward edge 108 to promote frictional engagement between collar 104 and a decorative light socket inserted therein. According to a particularly preferred embodiment of the invention, aperture 102 and the taper of surface 106 cooperate to securely hold a mini-light socket inserted into aperture 102 from the rear of collar 104. In this embodiment, the diameter of aperture 102 is approximately 0.37 inches (0.94 cm) at rear edge 110 and 0.35 inches (0.89 cm) at forward edge 108.

While the angular relationship between face portion 94 and base portion 96 of bracket 92 is shown as being substantially perpendicular in FIGS. 12 through 14, as well as in FIGS. 9 through 11, it will be understood that other similarly effective angular relationships can also be employed within the scope of the invention for use in particular applications.

Other alterations and modifications of the subject invention will become obvious to those of ordinary skill in the art upon reading this disclosure, and it is intended that the present invention be limited only by the broadest interpretation of the appended claims to which the inventor may be legally entitled.

What is claimed is:

1. A decorative light support device adapted to support and display a decorative light bulb and socket assembly on a roof structure, said device comprising a face portion and a base portion joined in angular relation to each other, said base portion adapted to be inserted between adjacent and overlapping layers of said building roof structure by the application of manual force and to maintain said device and said bulb and socket assembly in substantially fixed relation to said building roof structure solely by frictional contact between said base portion and said layers, said base portion further comprising top and bottom surfaces and at least one means adapted to be biased in a direction substantially perpendicular to one of said surfaces to enhance frictional contact between said base portion and at least one of said overlapping layers to restrict movement between said base portion and said overlapping layers pending the reapplication of manual force in substantially the opposite direction, said means being further adapted to be pressured against said bias into closer relation to one of said surfaces of said base portion during insertion of said base portion between said overlapping layers; said face portion further comprising at least one means adapted to support and maintain said decorative light bulb and socket assembly in substantially fixed relation so said face portion.

2. The device of claim 1 wherein said friction enhancing means of said base portion comprises at least one tab flexibly connected to the remainder of said base portion in such manner that said tab can be flexed to a position in which the end of said tab not connected to the remainder of said base portion is biased in a direction substantially perpendicular to the major plane of said base portion.

3. The device of claim 2 wherein said base portion is made of plastic and said tab is connected to the remainder of said base portion by a transversely extending zone of reduced thickness that functions as a fold line and hinge between said tab and the remainder of said base portion.

4. The device of claim 1 wherein said means adapted to support and maintain said decorative light bulb and socket assembly comprises at least one aperture.

5. The device of claim 4 wherein said aperture in said face portion is surrounded by an annular collar extending in a direction substantially perpendicular to the major plane of said face portion.

6. The device of claim 5 wherein said annular collar further comprises an interiorly facing tapered surface adapted to frictionally engage said socket.

7. The apparatus of claim 4 wherein said aperture is sized large enough to receive the base portion of a decorative light bulb therethrough before said light bulb is connected to said socket and small enough to prevent the connected light bulb and socket assembly from passing therethrough.

8. The device of claim 4 wherein said base portion further comprises a longitudinally extending notch.

9. The device of claim 4 wherein said face portion comprises a plurality of apertures of different sizes.

10. The device of claim 4 wherein said aperture in said face portion further comprises at least two adjacent segments having different diameters and having inwardly extending shoulders disposed therebetween to partially occlude said aperture.

11. The device of claim 1 wherein said base portion and said face portion are unitarily molded from a polymeric resin.

12. The device of claim 1 wherein said base portion and said face portion are stamped metal.

13. A device for supporting and displaying a decorative light bulb and socket assembly, said device comprising a face portion and an elongate base portion joined in angular relation to each other, said elongate base portion adapted to be inserted between adjacent overlapping layers of building materials on the fascia or roof structure of a building and maintained therebetween solely by frictional engagement between said base portion and said layers; said face portion comprising at least one aperture and an annular collar around said aperture adapted to support and maintain said light bulb and socket assembly.

14. The device of claim 13 wherein said annular collar further comprises an interiorly facing tapered surface adapted to frictionally engage said decorative bulb and socket assembly.

15. The apparatus of claim 13 wherein decorative light bulb comprises a base portion and said aperture is sized large enough to receive the base portion of the decorative light bulb therethrough before said light bulb is connected to said socket to form said light bulb and socket assembly and small enough to prevent the connected light bulb and socket assembly from passing therethrough.

16. The device of claim 13 wherein said base portion further comprises a longitudinally extending notch.

17. The device of claim 13 wherein said face portion comprises a plurality of apertures of different sizes.

18. The device of claim 13 wherein said aperture in said face portion further comprises at least two adjacent segments having different diameters and having inwardly extending shoulders disposed therebetween to partially occlude said aperture.

19. The device of claim 13 wherein said base portion and said face portion are unitarily molded from a polymeric resin.

* * * * *